US006391179B1

(12) United States Patent
Ogawa

(10) Patent No.: US 6,391,179 B1
(45) Date of Patent: May 21, 2002

(54) PLATING APPARATUS AND METHOD OF PREVENTING SUBSTITUTE DEPOSITION

(75) Inventor: Kenta Ogawa, Tokyo (JP)

(73) Assignee: NEC Corporation, Tokyo (JP)

( * ) Notice: Subject to any disclaimer, the term of this patent is extended or adjusted under 35 U.S.C. 154(b) by 9 days.

(21) Appl. No.: 09/624,335

(22) Filed: Jul. 24, 2000

(30) Foreign Application Priority Data

Jul. 23, 1999 (JP) ..... 11-209114

(51) Int. Cl.[7] ..... C25D 21/00

(52) U.S. Cl. ..... 205/98; 205/101; 205/238; 204/226; 204/227; 204/229.4

(58) Field of Search ..... 205/98, 101, 238; 204/226, 227, 229.4

(56) References Cited

U.S. PATENT DOCUMENTS 4,613,388 A * 9/1986 Walter et al. ..... 205/109
5,935,402 A * 8/1999 Fanti ..... 205/101

* cited by examiner

*Primary Examiner*—Arun S. Phasge
(74) *Attorney, Agent, or Firm*—Young & Thompson

(57) ABSTRACT

The present invention provides a plating apparatus comprising: a plating bath filled with a plating solution; at least an anode in the plating solution; at least a plating object which serves as a cathode in the plating solution, so that the at least plating object is distanced from the at least anode; and at least a dummy cathode in the plating solution, so that the at least dummy cathode is applied with voltage to suppress a substitute-deposition of metal ions in the plating solution.

20 Claims, 7 Drawing Sheets

Plating process

Plating process

No current application

Plating process

No current application

Plating process

No current application

PLATING APPARATUS AND METHOD OF PREVENTING SUBSTITUTE DEPOSITION

BACKGROUND OF THE INVENTION

The present invention relates to a plating apparatus and a method of preventing a substitute deposition.

The plating apparatus comprises an anode, a cathode and a plating solution. The anode serves as a plating-metal source, wherein the anode comprises an Sn—Pb alloy in the form of a plate or a ball contained in a basket or a bag. Surfaces of lead frames are activated in a pre-treatment to allow the lead frames to serve as a cathode. The plating liquid contains an organic acid or an additive. The lead frames are dipped into the plating liquid. A voltage is applied across the cathode and the anode to ionize Sn and Pb at the anode so that Su-ions and Pb-ions, mainly cations, are dissolved into the plating solution. On the cathode, The Sn ions and the Pb ions receive electrons, whereby an alloy coating film is formed on the surfaces of the lead frames as the cathode.

In the plating method using the Sn-based alloy except for Sn—Pb alloy, a difference in tendency of ionization, which is inherently possessed by each metal element, causes a substitute-deposition whereby a wettability and a plating-adhesiveness are dropped. The lead frames are dipped into the plating solution without receiving application of the voltage, for which reason the substitute-deposition is caused to form a metal film on the surface of the lead frame. Further, if during the plating process or after the formation of the plated film, the plating solution enters into an electroless state, then the substitute-deposition is caused to form the substitute-deposited coating film which is different from the intended alloy metal coating film. The substitute-deposited coating film deteriorates the solder-wettability and the adhesiveness with the base martial. The substitute-deposited coating film makes unstable the metal ratios and deposited composition of the plating solution. During the plating process with a current, motions of the metal ions are controllable by externally applying a voltage, whilst if the product or the anode remains dipped in the solution without any current application, then the substitute-deposition is likely to be caused. Namely, if no current is applied to the product or the anode in a time-period, then the substitute-deposition is likely to be caused. Particularly, in the lack-plating system, after a lack has completely been dropped with its gravity into the bottom, a current application is first commenced, for which reason the lack-plating system is engaged with the above problem.

In the lack-less plating system, if the current application is accidentally discontinued, then the substitute-deposition is also likely to be caused.

Further, the anode remains dipped in the plating solution even after the plating process has been finished, for which reason if the substitute-deposition is caused on the anode, it is necessary to remove pick-up the anode to receive the substitute-deposition coating film form the anode. This process is inconvenient and danger.

In the above circumstances, it had been required to develop a novel plating apparatus and a method of preventing a substitute-deposition free from the above problem.

SUMMARY OF THE INVENTION

Accordingly, it is an object of the present invention to provide a novel plating apparatus free from the above problems.

It is a further object of the present invention to provide a novel plating apparatus for plating an alloy of plural metal elements different in tendency of ionization.

It is a still further object of the present invention to provide a novel plating apparatus for plating an Sn—Bi alloy of plural metal elements Sn and Bi different in tendency of ionization.

It is yet a further object of the present invention to provide a novel plating apparatus for plating an Sn—Cu alloy of plural metal elements Sn and Cu different in tendency of ionization.

It is yet a further object of the present invention to provide a novel plating apparatus for plating an Sn—Ag alloy of plural metal elements Sn and Ag different in tendency of ionization.

It is yet a further object of the present invention to provide a novel plating apparatus for plating an Sn—Zn alloy of plural metal elements Sn and Zn different in tendency of ionization.

The first present invention provides a plating apparatus comprising: a plating bath filled with a plating solution; at least an anode in the plating solution; at least a plating object which serves as a cathode in the plating solution, so that the at least plating object is distanced from the at least anode; and at least a dummy cathode in the plating solution, so that the at least dummy cathode is applied with voltage to suppress a substitute-deposition of metal ions in the plating solution.

The second present invention provides a method of suppressing a substitution-deposition of metal ions in a plating solution filled in a plating bath which has at least an anode, at least a plating object serving as a cathode and at least a dummy cathode, and the plating solution containing at least two kinds of metal ions which are different in ionization tendency from each other, wherein when no voltage is applied to the plating object, the at least dummy cathode is applied with a voltage to suppress a substitute-deposition of metal ions.

The above and other objects, features and advantages of the present invention will be apparent from the following descriptions.

BRIEF DESCRIPTION OF THE DRAWINGS

Preferred embodiments according to the present invention will be described in detail with reference to the accompanying drawings.

DISCLOSURE OF THE INVENTION

Figure 1A:
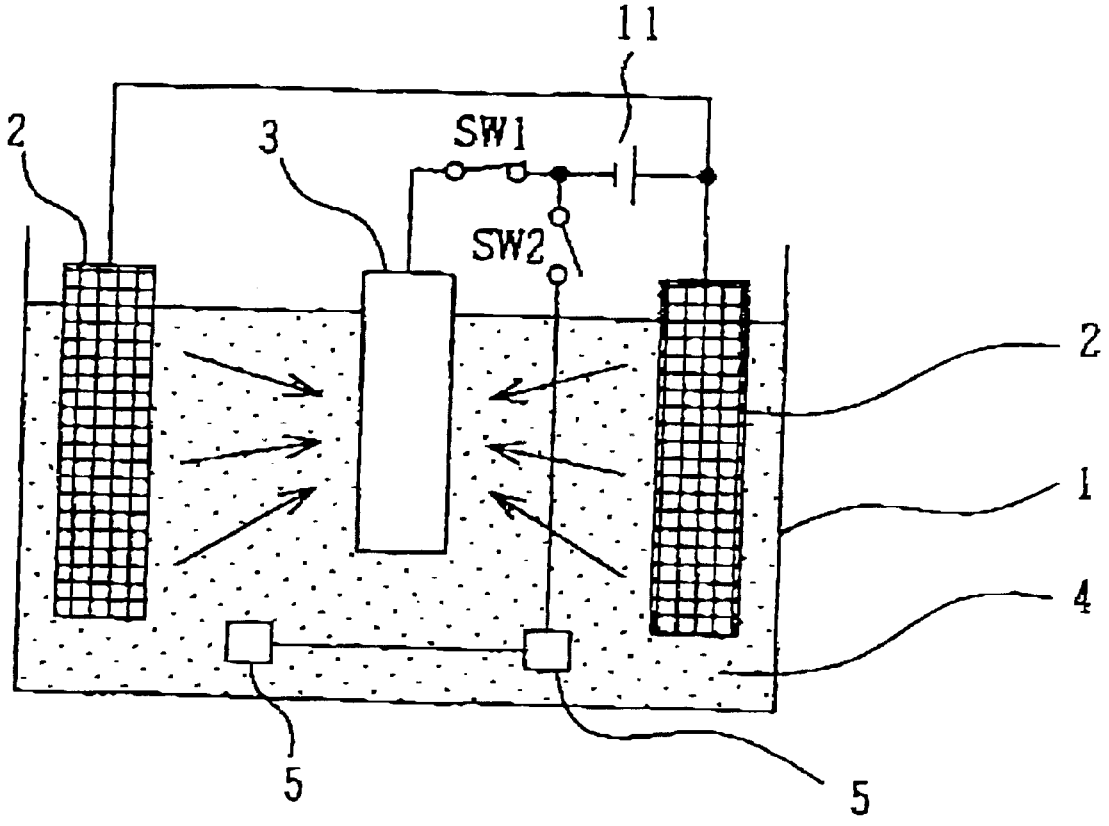
FIG. 1A is a view illustrative of a novel plating apparatus with dummy cathodes in a plating process in a first embodiment in accordance with the present invention.

The first present invention provides a plating apparatus comprising: a plating bath filled with a plating solution; at least an anode in the plating solution; at least a plating object which serves as a cathode in the plating solution, so that the at least plating object is distanced from the at least anode; and at least a dummy cathode in the plating solution, so that the at least dummy cathode is applied with voltage to suppress a substitute-deposition of metal ions in the plating solution.

It is preferable that the at least dummy cathode is applied with voltage when no voltage is applied to the plating object.

It is further preferable that the at least dummy cathode is applied with a predetermined constant voltage.

It is also preferable that a pair of the anodes is provided and a pair of the dummy cathodes is also provided in correspondence with the anodes.

It is also preferable that the at least dummy electrode is positioned closer to the at least anode than the at least plating object.

It is further preferable that the at least dummy electrode is positioned under an inter-space between the at least anode and the at least plating object.

It is further preferable that the at least dummy electrode is positioned in an opposite side of the at least anode to the at least plating object.

It is also preferable that the at least dummy electrode and the at least plating object are connected through first and second switches respectively to a common power source.

It is also preferable that in a plating process, a voltage is applied across the at least anode and the at least plating object and no voltage is applied to the at least dummy electrode, whilst in an electroless state, a voltage is applied across the at least dummy electrode and the at least anode, and no voltage is applied to the at least plating object.

It is also preferable that prior to a plating process, a voltage is applied across the at least dummy electrode and the at least anode, and no voltage is applied to the at least plating object, and in a subsequent plating process, a voltage is applied across the at least anode and both the at least plating object and the at least dummy electrode at least plating object and the at least dummy electrode, wherein the at least plating object and the at least dummy electrode having substantially the same potential.

It is preferable to further comprise an anode picking-up device for picking up the at least anode from the plating solution.

It is preferable to further comprise a reserve bath which is connected to the plating bath through a plating solution transfer system for transferring the plating solution, so that the plating solution transfer system transfers the plating solution from the plating bath to the reserve bath for entry into an electroless state, whilst the plating solution transfer system transfers the plating solution from the reserve bath to the plating bath for entry into a plating process.

It is further preferable that the plating solution transfer system comprises: a first pipe system with a first pump for transferring the plating solution from the plating bath to the reserve bath for entry into the electroless state; and a second pipe system with a second pump for transferring the plating solution from the reserve bath to the plating bath for entry into the plating process.

It is preferable that the plating solution contains at least two kinds of metal ions which are different in ionization tendency from each other.

The second present invention provides a method of suppressing a substitution-deposition of metal ions in a plating solution filled in a plating bath which has at least an anode, at least a plating object serving as a cathode and at least a dummy cathode, and the plating solution containing at least two kinds of metal ions which are different in ionization tendency from each other, wherein when no voltage is applied to the plating object, the at least dummy cathode is applied with a voltage to suppress a substitute-deposition of metal ions.

It is preferable that the at least dummy cathode is applied with a predetermined constant voltage.

It is also preferable that in a plating process, a voltage is applied across the at least anode and the at least plating object and no voltage is applied to the at least dummy electrode, whilst in an electroless state, a voltage is applied across the at least dummy electrode and the at least anode, and no voltage is applied to the at least plating object.

It is also preferable that prior to a plating process, a voltage is applied across the at least dummy electrode and the at least anode, and no voltage is applied to the at least plating object, and in a subsequent plating process, a voltage is applied across the at least anode and both the at least plating object and the at least dummy electrode at least plating object and the at least dummy electrode, wherein the at least plating object and the at least dummy electrode having substantially the same potential.

It is also preferable that in a plating process, the at least anode is dipped into the plating solution, whilst in an electroless state, the at least anode is picked up from the plating solution.

It is also preferable that the plating solution is transferred from the plating bath to the reserve bath for entry into an electroless state, whilst the plating solution is transferred from the reserve bath to the plating bath for entry into a plating process.

PREFERRED EMBODIMENT

Figure 1B:
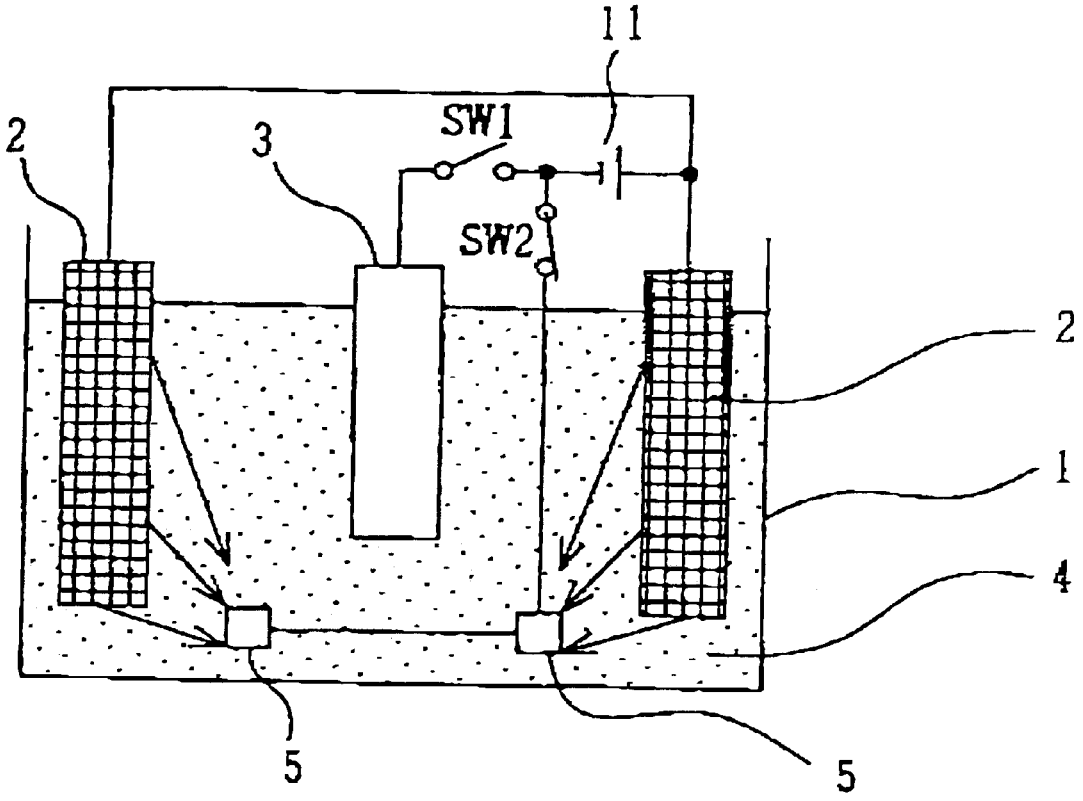
FIG. 1B is a view illustrative of a novel plating apparatus with dummy cathodes in no-current applying process in the first embodiment in accordance with the present invention.

FIRST EMBODIMENT:

A first embodiment according to the present invention will be described in detail with reference to the drawings. FIG. 1A is a view illustrative of a novel plating apparatus with dummy cathodes in a plating process in a first embodiment in accordance with the present invention. FIG. 1B is a view illustrative of a novel plating apparatus with dummy cathodes in no-current applying process in the first embodiment in accordance with the present invention. The novel plating apparatus has a plating bath 1 filled with a plating solution 4. A pair of anodes 2 is provided which is dipped into the plating solution 4. A plating object 3 serving as a cathode is provided which is dipped into the plating solution 4. The plating object 3 is connected through a first switch SW1 to a power source 11. The pair of the anodes 2 is also connected to the power source 11. A pair of dummy cathodes 5 are further provided which are dipped into the plating solution 4. The pair of the dummy cathodes 5 is positioned under inter-spaces between the plating object 3 and the anodes 2, so that the dummy cathodes 5 are not interposed between the plating object 3 and the anodes 2. It is possible as a modification that each of the dummy cathodes 5 is provided in an opposite side of each of the anode 2 to the plating object 3. In any event, the dummy cathodes 5 are provided in the plating solution 1 so that the dummy cathodes 5 are not interposed between the plating object 3 and the anodes 2. In this embodiment, the plating solution 4 has Sn-ions and Bi-ions. The Sn-ions are larger in ionization tendency than the Bi-ions, for which reason it is likely that the substitute-deposition of Bi-ions is caused. It is also necessary that the dummy cathodes 5 are made of a conductor which is unlikely to be dissolved into the plating solution 4, for example, stainless, or copper plate with a Pt-coated. Each of the dummy cathodes 5 is rod-shaped.

As shown in FIG. 1A, in the plating process, the first switch SW1 is closed to apply a voltage across the plating object 3 and the anodes 2, whilst the second switch SW2 is opened to apply no voltage to the dummy electrodes 5. In the plating process, at times when the plating operation is commenced or finished or an interval between lots, the plating subject 3 may not be immersed into the plating solution 4. Even if the plating subject 3 remains in the plating solution 4, it is possible that no voltage nor current is applied across the plating object 3 and the anodes 2. In this case, The Bi-ions in the plating solution 4 are likely to capture electrons from Sn of the plated film on the plating subject 3, whereby the substitute-deposition of the Bi-ions is caused. In order to prevent this substitute-deposition of the Bi-ions, in accordance with the present invention, as shown in FIG. 1B, the first switch SW1 is opened to apply no voltage across the plating object 3 and the anodes 2, whilst the second switch SW2 is closed to apply a voltage across the dummy electrodes 5 and the anodes 2 to suppress the substitute-deposition of the Bi-ions. The switching operations of the first and second switches SW1 and SW2 may be controlled by sequencers. Namely, the plating object 3 or the product is prevented from the electroless state. In order to prevent the plating object 3 or the product from the electroless state, the voltage is always applied between the dummy cathodes 5 and the anodes 2 even before and after the plating object 3 is dipped into the plating solution 4. It is optimum to apply a constant voltage to make the plating object free from the influence due to the dipped area of the plating object 3. The provision of the dummy electrodes 5 prevents a current concentration to edges of the plating object 3.

Although the above descriptions have been made by taking Sn—Bi plating as an example, it is of course possible to avail the above novel plating apparatus and the process to other alloy plating, for example, Sn—Cu, Su-Ag, Sn—Zn.

Accordingly, in accordance with the first present invention, the provision of the dummy cathodes may prevent the substitute-deposition on the plating subject or the anodes in the electroless state, thereby improving the plating quality.

Figure 2A:
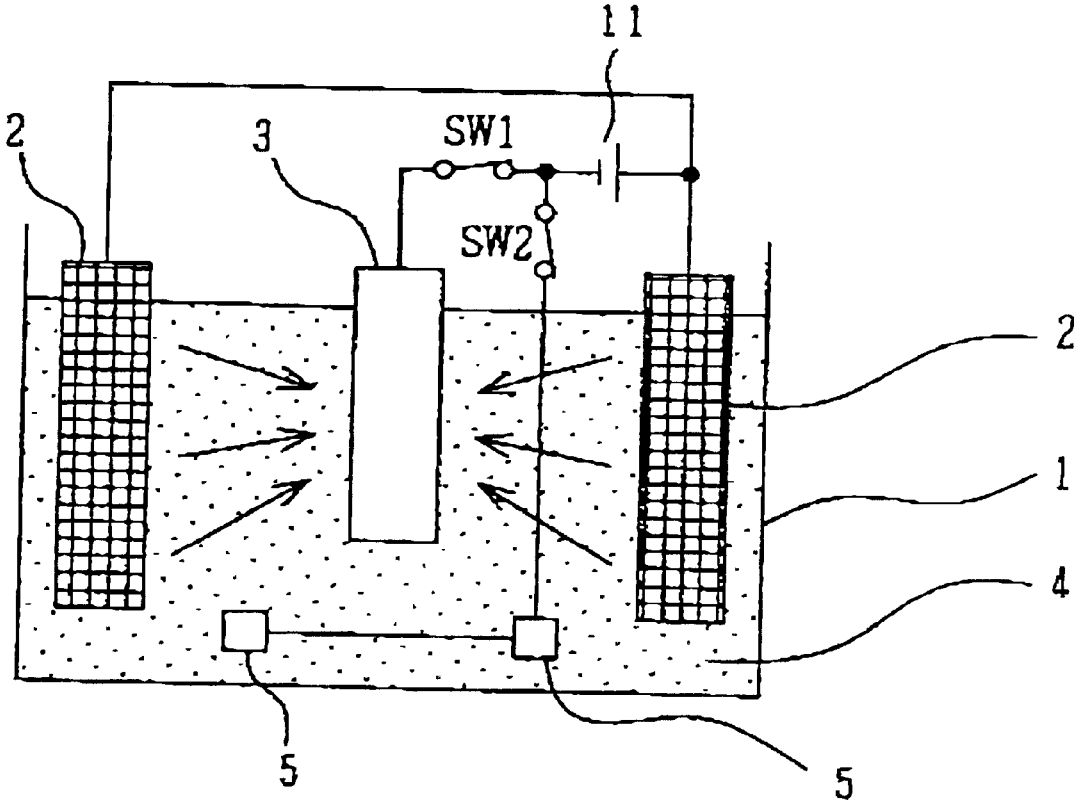
FIG. 2A is a view illustrative of a novel plating apparatus with dummy cathodes in a plating process in a second embodiment in accordance with the present invention.
Figure 2B:
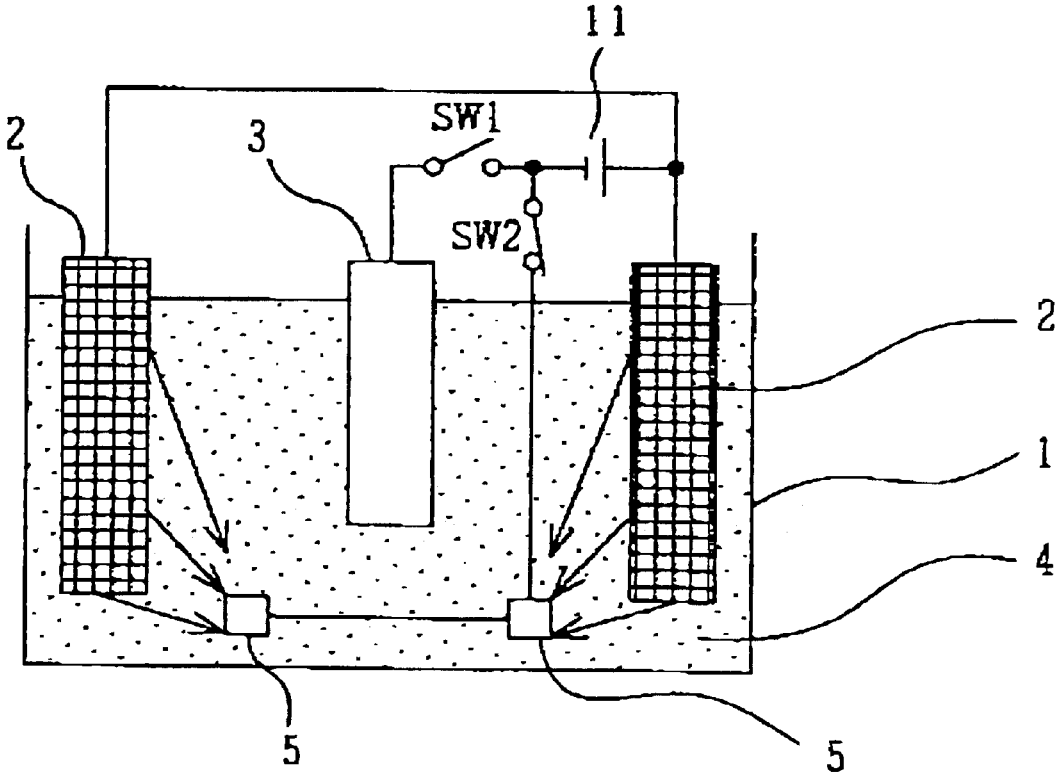
FIG. 2B is a view illustrative of a novel plating apparatus with dummy cathodes in no-current applying process in the second embodiment in accordance with the present invention.

SECOND EMBODIMENT:

A second embodiment according to the present invention will be described in detail with reference to the drawings. FIG. 2A is a view illustrative of a novel plating apparatus with dummy cathodes in a plating process in a second embodiment in accordance with the present invention. FIG. 2B is a view illustrative of a novel plating apparatus with dummy cathodes in no-current applying process in the second embodiment in accordance with the present invention. The novel plating apparatus has a plating bath 1 filled with a plating solution 4. A pair of anodes 2 is provided which is dipped into the plating solution 4. A plating object 3 serving as a cathode is provided which is dipped into the plating solution 4. The plating object 3 is connected through a first switch SW1 to a power source 11. The pair of the anodes 2 is also connected to the power source 11. A pair of dummy cathodes 5 are further provided which are dipped into the plating solution 4. The pair of the dummy cathodes 5 is positioned under inter-spaces between the plating object 3 and the anodes 2, so that the dummy cathodes 5 are not interposed between the plating object 3 and the anodes 2. It is possible as a modification that each of the dummy cathodes 5 is provided in an opposite side of each of the anode 2 to the plating object 3. In any event, the dummy cathodes 5 are provided in the plating solution 1 so that the dummy cathodes 5 are not interposed between the plating object 3 and the anodes 2. In this embodiment, the plating solution 4 has Sn-ions and Bi-ions. The Sn-ions are larger in ionization tendency than the Bi-ions, for which reason it is likely that the substitute-deposition of Bi-ions is caused. It is also necessary that the dummy cathodes 5 are made of a conductor which is unlikely to be dissolved into the plating solution 4, for example, stainless, or copper plate with a Pt-coated. Each of the dummy cathodes 5 is rod-shaped.

In this embodiment, before the plating process is commenced, as shown in FIG. 2B, the first switch SW1 is opened to apply no voltage across the plating object 3 and the anodes 2, whilst the second switch SW2 is closed to apply a voltage across the dummy electrodes 5 and the anodes 2 in order to prevent this substitute-deposition of the Bi-ions. In the subsequent plating process, as shown in FIG. 2A, the first switch SW1 is closed to apply a voltage across the plating object 3 and the anodes 2, and also the second switch SW2 is closed to apply a voltage across the dummy electrodes 5 and the anodes 2 to carry out the plating process.

The switching operations of the first and second switches SW1 and SW2 may be controlled be sequencers. Namely, the plating object 3 or the product is prevented from the electroless state. In order to prevent the plating object 3 or the product from the electroless state, the voltage is always applied between the dummy cathodes 5 and the anodes 2 even before and after the plating object 3 is dipped into the plating solution 4. It is optimum to apply a constant voltage to make the plating object free from the influence due to the dipped area of the plating object 3. The provision of the dummy electrodes 5 prevents a current concentration to edges of the plating object 3.

Although the above descriptions have been made by taking Sn—Bi plating as an example, it is of course possible to avail the above novel plating apparatus and the process to other alloy plating, for example, Sn—Cu, Su-Ag, Sn—Zn.

Accordingly, in accordance with the first present invention, the provision of the dummy cathodes may prevent the substitute-deposition on the plating subject or the anodes in the electroless state, thereby improving the plating quality.

Figure 3A:
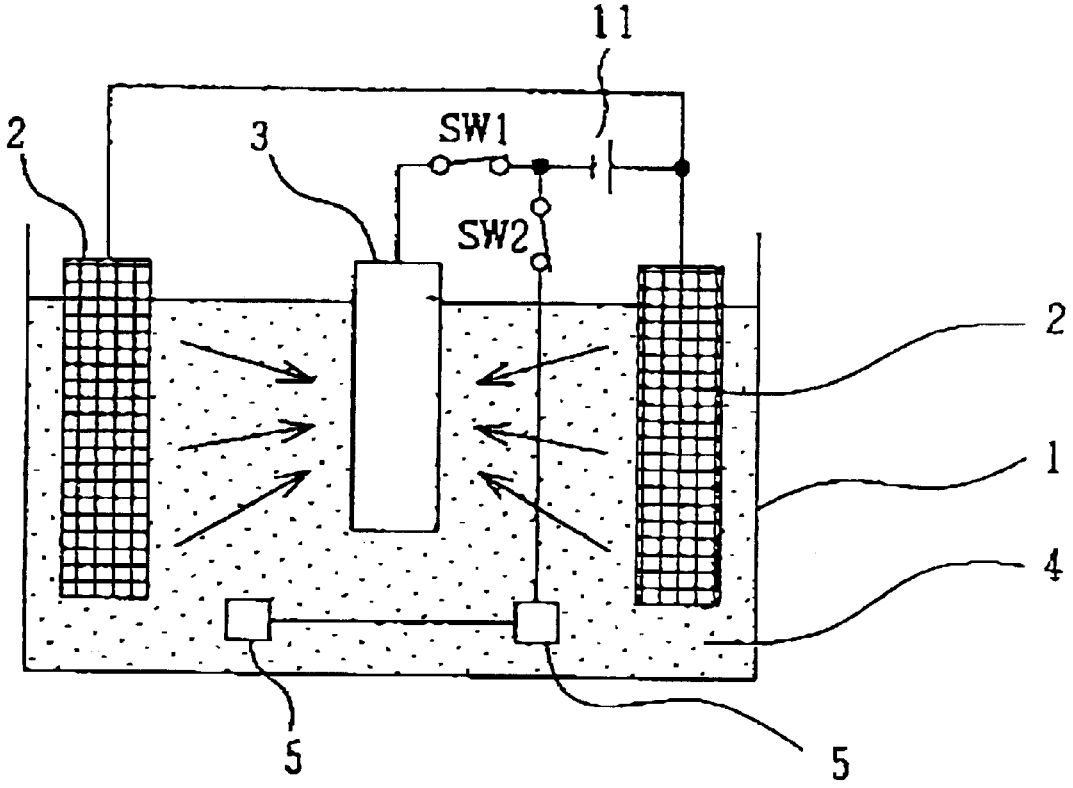
FIG. 3A is a view illustrative of a novel plating apparatus with dummy cathodes in a plating process in a third embodiment in accordance with the present invention.
Figure 3B:
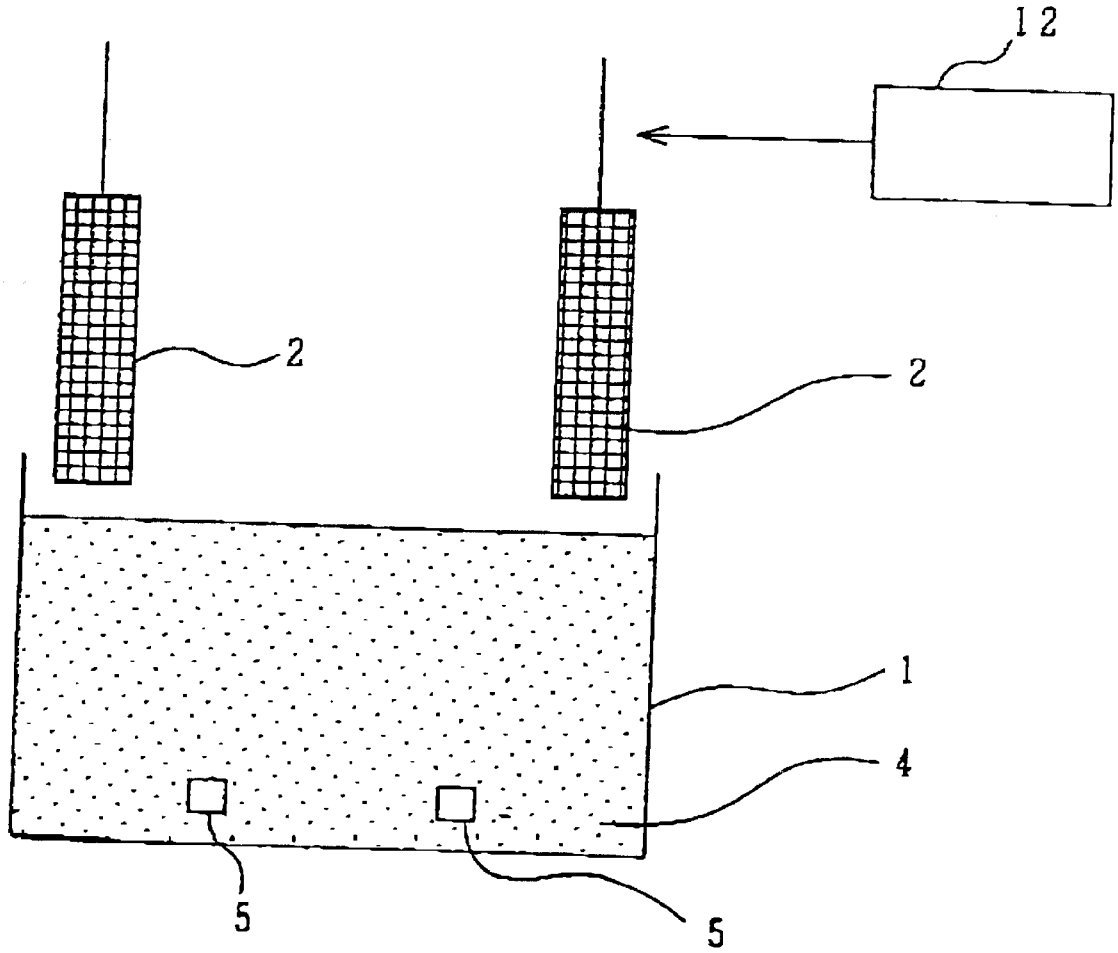
FIG. 3B is a view illustrative of a novel plating apparatus with dummy cathodes in no-current applying process in the third embodiment in accordance with the present invention.

THIRD EMBODIMENT:

A third embodiment according to the present invention will be described in detail with reference to the drawings. FIG. 3A is a view illustrative of a novel plating apparatus with dummy cathodes in a plating process in a third embodiment in accordance with the present invention. FIG. 3B is a view illustrative of a novel plating apparatus with dummy cathodes in no-current applying process in the third embodiment in accordance with the present invention. The novel plating apparatus has a plating bath 1 filled with a plating solution 4. A pair of anodes 2 is provided which is dipped into the plating solution 4. A plating object 3 serving as a cathode is provided which is dipped into the plating solution 4. The plating object 3 is connected through a first switch SW1 to a power source 11. The pair of the anodes 2 is also connected to the power source 11. A pair of dummy cathodes 5 are further provided which are dipped into the plating solution 4. The pair of the dummy cathodes 5 is positioned under inter-spaces between the plating object 3 and the anodes 2, so that the dummy cathodes 5 are not interposed between the plating object 3 and the anodes 2. It is possible as a modification that each of the dummy cathodes 5 is provided in an opposite side of each of the anode 2 to the plating object 3. In any event, the dummy cathodes 5 are provided in the plating solution 1 so that the dummy cathodes 5 are not interposed between the plating object 3 and the anodes 2. In this embodiment, the plating solution 4 has Sn-ions and Bi-ions. The Sn-ions are larger in ionization tendency than the Bi-ions, for which reason it is likely that the substitute-deposition of Bi-ions is caused. It is also necessary that the dummy cathodes 5 are made of a conductor which is unlikely to be dissolved into the plating solution 4, for example, stainless, or copper plate with a Pt-coated. Each of the dummy cathodes 5 is rod-shaped. Further, in this embodiment, an anode pick-up device 12 is additionally provided for picking up the anodes 2 in the electroless state.

As shown in FIG. 3A, in the plating process, the first switch SW1 is closed to apply a voltage across the plating object 3 and the anodes 2, whilst the second switch SW2 is opened to apply no voltage to the dummy electrodes 5. In the plating process, at times when the plating operation is commenced or finished or an interval between lots, the plating subject 3 may not be immersed into the plating solution 4. Even if the plating subject 3 remains in the plating solution 4, it is possible that no voltage nor current is applied across the plating object 3 and the anodes 2. In this case, The Bi-ions in the plating solution 4 are likely to capture electrons from Sn of the plated film on the plating subject 3, whereby the substitute-deposition of the Bi-ions is caused. In order to prevent this substitute-deposition of the Bi-ions, in accordance with the present invention, as shown in FIG. 3B, the anodes 2 are picked up from the plating solution 4, so that the anodes 2 are washed with water. Even if it is difficult to remove the substitute-deposition from the anodes 2, then it is possible to physically remove the substitute-deposition from the anodes 2. In this case, even if a long time discontinuation of the plating operation is necessary, then it is unnecessary to continuously apply the voltage across the dummy electrodes 5 and the anodes 2 to reduce the running cost and make it easy for maintenance thereof. The above switching operations of the first and second switches SW1 and SW2 may be controlled by sequencers. Namely, the plating object 3 or the product is prevented from the electroless state. The provision of the dummy electrodes 5 prevents a current concentration to edges of the plating object 3.

Although the above descriptions have been made by taking Sn—Bi plating as an example, it is of course possible to avail the above novel plating apparatus and the process to other alloy plating, for example, Sn—Cu, Su-Ag, Sn—Zn.

Accordingly, in accordance with the first present invention, the provision of the dummy cathodes may prevent the substitute-deposition on the plating subject or the anodes in the electroless state, thereby improving the plating quality.

Figure 4:
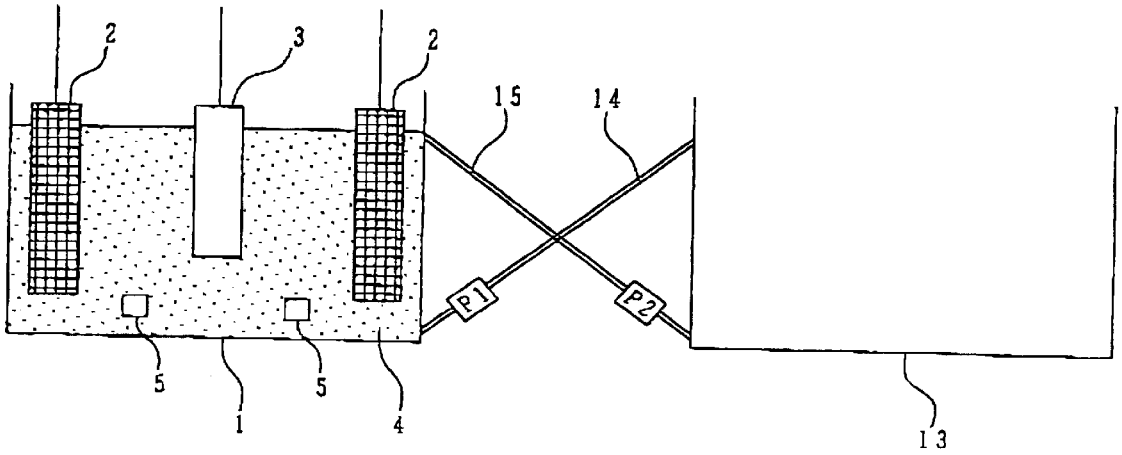
FIG. 4 is a view illustrative of a novel plating apparatus with dummy cathodes in a plating process in a fourth embodiment in accordance with the present invention.

FOURTH EMBODIMENT:

A fourth embodiment according to the present invention will be described in detail with reference to the drawings. FIG. 4 is a view illustrative of a novel plating apparatus with dummy cathodes in a plating process in a fourth embodiment in accordance with the present invention. The novel plating apparatus has not only a plating bath 1 filled with a plating solution 4 but also a reserve bath 13 which is connected through first and second pipes 14 and 15. The first pipe 14 has a first pump P1. The second pipe 15 has a second pump P2. The first pipe 14 in combination with the first pump P1 serves to transfer the plating solution 4 in the plating bath 1 to the reserve bath 13 before entry into the electroless state. The second pipe 15 in combination with the second pump P2 serves to transfer the plating solution 4 in the reserve bath 13 to the plating bath 1 before entry into the plating process. A pair of anodes 2 is provided which is dipped into the plating solution 4. A plating object 3 serving as a cathode is provided which is dipped into the plating solution 4. Similarly to the first embodiment, the plating object 3 is connected through a first switch SW1 to a power source 11, and the pair of the anodes 2 is also connected to the power source 11. A pair of dummy cathodes 5 are further provided which are dipped into the plating solution 4. The pair of the dummy cathodes 5 is positioned under inter-spaces between the plating object 3 and the anodes 2, so that the dummy cathodes 5 are not interposed between the plating object 3 and the anodes 2. It is possible as a modification that each of the dummy cathodes 5 is provided in an opposite side of each of the anode 2 to the plating object 3. In any event, the dummy cathodes 5 are provided in the plating solution 1 so that the dummy cathodes 5 are not interposed between the plating object 3 and the anodes 2. In this embodiment, the plating solution 4 has Sn-ions and Bi-ions. The Sn-ions are larger in ionization tendency than the Bi-ions, for which reason it is likely that the substitute-deposition of Bi-ions is caused. It is also necessary that the dummy cathodes 5 are made of a conductor which is unlikely to be dissolved into the plating solution 4, for example, stainless, or copper plate with a Pt-coated. Each of the dummy cathodes 5 is rod-shaped.

In the plating process, the first switch SW1 is closed to apply a voltage across the plating object 3 and the anodes 2, whilst the second switch SW2 is opened to apply no voltage to the dummy electrodes 5. In the plating process, at times when the plating operation is commenced or finished or an interval between lots, the plating subject 3 may not be immersed into the plating solution 4. Even if the plating subject 3 remains in the plating solution 4, it is possible that no voltage nor current is applied across the plating object 3 and the anodes 2. In this case, The Bi-ions in the plating solution 4 are likely to capture electrons from Sn of the plated film on the plating subject 3, whereby the substitute-deposition of the Bi-ions is caused. In order to prevent this substitute-deposition of the Bi-ions, in accordance with the present invention, the first switch SW1 is opened to apply no voltage across the plating object 3 and the anodes 2, whilst the second switch SW2 is closed to apply a voltage across the dummy electrodes 5 and the anodes 2 to suppress the substitute-deposition of the Bi-ions. The switching operations of the first and second switches SW1 and SW2 may be controlled by sequencers. Namely, the plating object 3 or the product is prevented from the electroless state. In order to prevent the plating object 3 or the product from the electroless state, the voltage is always applied between the dummy cathodes 5 and the anodes 2 even before and after the plating object 3 is dipped into the plating solution 4. It is optimum to apply a constant voltage to make the plating object free from the influence due to the dipped area of the plating object 3. The provision of the dummy electrodes 5 prevents a current concentration to edges of the plating object 3.

In this case, even if a long time discontinuation of the plating operation is necessary, the first pipe 14 in combination with the first pump P1 is operated to transfer the plating solution 4 in the plating bath 1 to the reserve bath 13, so that it is unnecessary to continuously apply the voltage across the dummy electrodes 5 and the anodes 2 to reduce the running cost and make it easy for maintenance thereof in the electroless state. The second pipe 15 in combination with the second pump P2 is then operated to transfer the plating solution 4 in the reserve bath 13 to the plating bath 1 before the electro-plating process is commenced.

Although the above descriptions have been made by taking Sn—Bi plating as an example, it is of course possible to avail the above novel plating apparatus and the process to other alloy plating, for example, Sn—Cu, Su-Ag, Sn—Zn.

Accordingly, in accordance with the first present invention, the provision of the dummy cathodes may prevent the substitute-deposition on the plating subject or the anodes in the electroless state, thereby improving the plating quality.

Whereas modifications of the present invention will be apparent to a person having ordinary skill in the art, to which the invention pertains, it is to be understood that embodiments as shown and described by way of illustrations are by no means intended to be considered in a limiting sense. Accordingly, it is to be intended to cover by claims all modifications which fall within the spirit and scope of the present invention.

What is claimed is:

1. A plating apparatus comprising:

a plating bath filled with a plating solution;

at least an anode in said plating solution;

at least a plating object which serves as a cathode in said plating solution, so that said at least plating object is distanced from said at least anode;

at least a dummy cathode in said plating solution; and means for selectively connecting said dummy cathode and said plating object to a common power source.

2. The plating apparatus as claimed in claim 1, wherein said means for selectively connecting connects said dummy cathode to said common power source when said common power source is not connected to said plating object.

3. The plating apparatus as claimed in claim 2, wherein said at least dummy cathode is applied with a predetermined constant voltage.

4. The plating apparatus as claimed in claim 1, wherein a pair of said anodes is provided and a pair of said dummy cathodes is also provided in correspondence with said anodes.

5. The plating apparatus as claimed in claim 1, wherein said at least dummy electrode is positioned closer to said at least anode than said at least plating object.

6. The plating apparatus as claimed in claim 5, wherein said at least dummy electrode is positioned under an interspace between said at least anode and said at least plating object.

7. The plating apparatus as claimed in claim 5, wherein said at least dummy electrode is positioned in an opposite side of said at least anode to said at least plating object.

8. The plating apparatus as claimed in claim 1, wherein in a plating process, a voltage is applied across said at least anode and said at least plating object and no voltage is applied to said at least dummy electrode, whilst in an electroless state, a voltage is applied across said at least dummy electrode and said at least anode, and no voltage is applied to said at least plating object.

9. The plating apparatus as claimed in claim 1, wherein prior to a plating process, a voltage is applied across said at least dummy electrode and said at least anode, and no voltage is applied to said at least plating object, and in a subsequent plating process, a voltage is applied across said at least anode and both said at least plating object and said at least dummy electrode at least plating object and said at least dummy electrode, wherein said at least plating object and said at least dummy electrode having substantially the same potential.

10. The plating apparatus as claimed in claim 1, wherein said plating solution contains at least two kinds of metal ions which are different in ionization tendency from each other.

11. A plating apparatus comprising:

a plating bath filled with a plating solution;

at least an anode in said plating solution;

at least a plating object which serves as a cathode in said plating solution, so that said at least plating object is distanced from said at least anode; and at least a dummy cathode in said plating solution, so that said at least dummy cathode is applied with voltage to suppress a substitute-deposition of metal ions in said plating solution, wherein said at least dummy electrode and said at least plating object are connected through first and second switches respectively to a common power source.

12. A plating apparatus comprising:

a plating bath filled with a plating solution;

at least an anode in said plating solution;

at least a plating object which serves as a cathode in said plating solution, so that said at least plating object is distanced from said at least anode;

at least a dummy cathode in said plating solution, so that said at least dummy cathode is applied with voltage to suppress a substitute-deposition of metal ions in said plating solution; and a reserve bath connected to said plating bath through a plating solution transfer system for transferring said plating solution, so that said plating solution transfer system transfers said plating solution from said plating bath to said reserve bath for entry into an electroless state, while said plating solution transfer system transfers said plating solution from said reserve bath to said plating bath for entry into a plating process.

13. The plating apparatus as claimed in claim 12, wherein said plating solution transfer system comprises:

a first pipe system with a first pump for transferring said plating solution from said plating bath to said reserve bath for entry into said electroless state; and a second pipe system with a second pump for transferring said plating solution from said reserve bath to said plating bath for entry into said plating process.

14. A plating apparatus comprising:

a plating bath filled with a plating solution;

at least an anode in said plating solution;

at least a plating object which serves as a cathode in said plating solution, so that said at least plating object is distanced from said at least anode;

at least a dummy cathode in said plating solution, so that said at least dummy cathode is applied with voltage to suppress a substitute-deposition of metal ions in said plating solution; and an anode picking-up device for picking up said at least anode from said plating solution.

15. A method of suppressing a substitution-deposition of metal ions in a plating solution filled in a plating bath which has at least an anode, at least a plating object serving as a cathode and at least a dummy cathode, and said plating solution containing at least two kinds of metal ions which are different in ionization tendency from each other, the method comprising a step for selectively switching a voltage from a common power source to said plating object and to said at least dummy cathode for suppressing a substitute-deposition of metal ions.

16. The method as claimed in claim 15, wherein said at least dummy cathode is applied with a predetermined constant voltage.

17. The method as claimed in claim 15, wherein in a plating process, a voltage is applied across said at least anode and said at least plating object and no voltage is applied to said at least dummy electrode, whilst in an electroless state, a voltage is applied across said at least dummy electrode and said at least anode, and no voltage is applied to said at least plating object.

18. The method as claimed in claim 15, wherein prior to a plating process, a voltage is applied across said at least dummy electrode and said at least anode, and no voltage is applied to said at least plating object, and in a subsequent plating process, a voltage is applied across said at least anode and both said at least plating object and said at least dummy electrode at least plating object and said at least dummy electrode, wherein said at least plating object and said at least dummy electrode having substantially the same potential.

19. A method of suppressing a substitution-deposition of metal ions in a plating solution filled in a plating bath which has at least an anode, at least a plating object serving as a cathode and at least a dummy cathode, and said plating solution containing at least two kinds of metal ions which are different in ionization tendency from each other, wherein when no voltage is applied to said plating object, said at least dummy cathode is applied with a voltage to suppress a substitute-deposition of metal ions; and wherein in a plating process, said at least anode is dipped into said plating solution, while in an electroless state, said at least anode is picked up from said plating solution.

20. A method of suppressing a substitution-deposition of metal ions in a plating solution filled in a plating bath which has at least an anode, at least a plating object serving as a cathode and at least a dummy cathode, and said plating solution containing at least two kinds of metal ions which are different in ionization tendency from each other, wherein when no voltage is applied to said plating object, said at least dummy cathode is applied with a voltage to suppress a substitute-deposition of metal ions; and wherein said plating solution is transferred from said plating bath to said reserve bath for entry into an electroless state, while said plating solution is transferred from said reserve bath to said plating bath for entry into a plating process.

* * * * *